United States Patent [19]

Greaves et al.

[11] Patent Number: 4,692,315

[45] Date of Patent: Sep. 8, 1987

[54] METHOD OF INHIBITING CORROSION IN AQUEOUS SYSTEMS

[75] Inventors: Brian Greaves; Paul Ingham, both of Runcorn, England

[73] Assignee: Dearborn Chemicals Limited, Widnes, England

[21] Appl. No.: 724,229

[22] Filed: Apr. 17, 1985

[30] Foreign Application Priority Data

Apr. 25, 1984 [GB] United Kingdom ..... 8410589

[51] Int. Cl.[4] ..... C23F 11/14; C23F 11/08

[52] U.S. Cl. ..... 422/18; 252/389.2; 252/389.52; 252/390; 422/14; 422/16

[58] Field of Search ..... 422/14, 15, 16, 18; 210/698, 699, 700; 252/390, 394, 395, 396, 389.2, 389.21, 389.52

[56] References Cited

U.S. PATENT DOCUMENTS

| | | |
|---|---|---|
| 2,729,557 | 1/1956 | Booth et al. . |
| 2,926,154 | 2/1960 | Keim . |
| 3,036,305 | 5/1962 | Channabasappa et al. . |
| 3,215,654 | 11/1965 | Schmalz . |
| 3,240,664 | 3/1966 | Earle, Jr. . |
| 3,311,594 | 3/1967 | Earle, Jr. . |
| 3,332,871 | 8/1964 | Robinson . |
| 3,462,365 | 8/1969 | Vogelsang, Jr. . |
| 3,623,991 | 11/1971 | Sabatelli et al. . |
| 3,639,292 | 2/1972 | Gilby . |
| 3,658,710 | 4/1972 | Puckerius et al. . |
| 3,752,761 | 8/1973 | Boothe et al. . |
| 3,793,194 | 2/1974 | Zecher . |
| 3,837,803 | 9/1974 | Carter et al. . |
| 3,982,894 | 9/1976 | Annand et al. . |
| 4,038,451 | 7/1977 | Brown et al. . |
| 4,042,324 | 8/1977 | Auel et al. . |
| 4,052,160 | 10/1977 | Cook et al. . |
| 4,057,511 | 11/1977 | Bohnsack et al. . |
| 4,085,060 | 4/1978 | Vassileff . |
| 4,297,237 | 10/1981 | Boffardi . |
| 4,323,461 | 4/1982 | Quinlan . |
| 4,387,027 | 6/1983 | May et al. . |
| 4,557,896 | 12/1985 | Brocklebank et al. . |

FOREIGN PATENT DOCUMENTS

| | | |
|---|---|---|
| 0075514 | 3/1983 | European Pat. Off. . |
| 2310450 | 9/1974 | Fed. Rep. of Germany . |
| 2505435 | 8/1976 | Fed. Rep. of Germany . |
| 1598419 | 8/1970 | France . |
| 2130717 | 11/1972 | France . |
| 2235205 | 1/1975 | France . |
| 1208827 | 10/1970 | United Kingdom . |
| 1297515 | 11/1972 | United Kingdom . |
| 1348595 | 3/1974 | United Kingdom . |
| 1452557 | 10/1976 | United Kingdom . |
| 1486396 | 9/1977 | United Kingdom . |
| 1520915 | 8/1978 | United Kingdom . |
| 1539974 | 2/1979 | United Kingdom . |
| 1577495 | 10/1980 | United Kingdom . |
| 1589109 | 5/1981 | United Kingdom . |
| 2066234 | 7/1981 | United Kingdom . |
| 2085433A | 4/1982 | United Kingdom . |
| 2105319 | 3/1983 | United Kingdom . |
| 2112370 | 7/1983 | United Kingdom . |

OTHER PUBLICATIONS

Betz Handbook of Industrial Water Conditioning, 7th Ed, 1976, pp. 198–200.

Research Disclosure 23229; Ciba-Geigy PLC; "Inhibiting Corrosion and Scale Deposition", Aug. 1983.

Patent Abstracts of Japan, unexamined Applications, C Field, vol. 8, No. 184, p. 35 C 239, Aug. 23, 1984.

*Primary Examiner*—Barry S. Richman
*Assistant Examiner*—William R. Johnson
*Attorney, Agent, or Firm*—David E. Heiser

[57] ABSTRACT

A method for inhibiting corrosion in an aqueous system is described which comprises adding to the system a corrosion inhibiting metal salt capable of forming a passivating film of a water insoluble salt of said metal at the cathode, and a substantially linear cationic polymer.

44 Claims, No Drawings

METHOD OF INHIBITING CORROSION IN AQUEOUS SYSTEMS

This invention relates to the inhibition of corrosion in aqueous systems, especially in cooling water systems and their associated equipment.

A variety of different salts have been used to inhibit corrosion. These salts act, in general, by forming a passivating or protective film, generally at the anode of the galvanic cells which form during the corrosion process. Most of these salts, including phosphates, nitrites, chromates, phosphonates and molybdates, form a passivating film at the anode but a few, notably zinc salts, form the passivating film at the cathode. Those which form a passivating film at the anode generally give rise to a film of gamma-ferric oxide while those which form a passivating film at the cathode generally give rise to a hydroxide or phosphate of the metal of the corrosion inhibiting salt. Although many of these salts are reasonably effective they all possess one or more drawbacks.

The use of zinc salts or blends of zinc salts with ortho- or polyphosphate for the control of corrosion of ferrous metals in aqueous systems is well known. These additives are generally used in conjunction with either polycarboxylic acids, phosphinocarboxylic acids or phosphonates or blends of these materials. While, under certain conditions, corrosion rates may be kept low using these additives they are not entirely satisfactory in that their effectiveness decreases at the higher temperature found in some cooling systems. Under these conditions the tendency has been to increase the dose level of additive, but this in turn leads to precipitation of insoluble zinc salts which settle out on surfaces and cause fouling, in some cases, to such an extent as to increase the corrosion rate due to under deposit corrosion.

It is also well known that the use of zinc salts in combination with chromates provides excellent corrosion protection in aqueous systems. However, the use of hexavalent chromium salts at concentrations of 15 ppm or more is environmentally unacceptable for toxicity reasons. This has, therefore, considerably curtailed the use of zinc salts for this purpose.

It has now been found, according to the present invention, that the amounts of a corrosion controlling or inhibiting metal salt which is capable of forming a passivating or protective cathodic film of said metal, generally as the metal hydroxide or phosphate, can be reduced significantly if it is used in combination with a cationic polymer. It has been found that a useful synergistic effect can be obtained with the result that a composition which is effective in rapidly forming a passivating film and subsequently inhibiting corrosion can be provided which contains much smaller amounts of the corrosion inhibiting salt. Accordingly, the present invention provides a method for inhibiting corrosion in an aqueous system which comprises adding to the system a corrosion inhibiting metal salt capable of forming a passivating film of a water insoluble salt of said metal, typically the hydroxide or phosphate at the cathode (or cathodic film) and a cationic polymer. The present invention is of general applicability both as regards the precise nature of the polymer and the precise nature of the corrosion inhibiting metal salt provided it is capable of forming an insoluble metal salt at the cathode. Thus useful synergistic combinations can be obtained with a variety of different types of cationic polymer; typical corrosion inhibiting salts include salts of zinc, nickel, chromium and aluminium, which are capable of forming a passivating cathodic film. The use of zinc salts is preferred. These salts are typically water soluble salts, especially sulphate, chloride and nitrate. Zinc sulphate is especially preferred. Ammonium salts are generally not to be recommended as they may promote attack on yellow metals such as copper or brass. The present invention has particular utility when used in combination with orthophosphates or polyphosphates, especially alkali metal, such as disodium or trisodium, orthophosphate. In general, by using the specified cationic polymers it is possible to use less than 10 ppm of corrosion inhibiting salt and, indeed amounts of, say, 5 ppm of such salt together with a similar quantity of polymer is much more effective than the use of 10 ppm of such salt by itself.

A considerable variety of different polymers can be used provided that they are cationic; preferably they are substantially linear i.e. polymers which have substantially no crosslinking but which may contain, for example, cyclic groups in a substantially linear chain. Although it is possible to use, for instance, polyalkyleimines, typically polyethyleneimines, especially low molecular weight polyethyleneimines, for example molecular weight up to 5,000 and especially up to 2,000 including tetraethylene pentamine and triethylene tetramine, it is generally preferred to use protonated or quaternary ammonium polymers. These quaternary ammonium polymers are preferably derived from ethylenically unsaturated monomers containing a quaternary ammonium group or are obtained by reaction between a polyalkylene polyamine and epichlorohydrin, or by reaction between epichlorhydrin dimethylamine and either ethylene diamine or polyalkylene polyamine.

Typical cationic polymers which can be used in the present invention and which are derived from an ethylenically unsaturated monomer include homo- and copolymers of vinyl compounds such as (a) vinyl pyridine and vinyl imidazole which may be quaternised with, say, a $C_1$ to $C_{18}$ alkyl halide, a benzyl halide, especially a chloride, or dimethyl or diethyl sulphate, or (b) vinyl benzyl chloride which may be quaternised with, say, a tertiary amine of formula $NR_1R_2R_3$ in which $R_1$ $R_2$ and $R_3$ are independently lower alkyl, typically of 1 to 4 carbon atoms, such that one of $R_1$ $R_2$ and $R_3$ can be $C_1$ to $C_{18}$ alkyl; allyl compounds such as diallyldimethyl ammonium chloride; or acrylic derivatives such as (i) a dialkyl aminomethyl(meth)acrylamide which may be quaternised with, say, a $C_1$ to $C_{18}$ alkyl halide, a benzyl halide or dimethyl or diethyl sulphate, (ii) a methacrylamido propyl tri($C_1$ to $C_4$ alkyl, especially methyl) ammonium salt, of (iii) a(meth)acryloyloxyethyl tri($C_1$ to $C_4$ alkyl, especially methyl) ammonium salt, said salt (ii) or (iii) being a halide, especially a chloride, methosulphate, ethosulphate or 1/n of an n-valent anion. These monomers may be copolymerised with a (meth)acrylic derivative such as acrylamide, an acrylate or methacrylate $C_1$–$C_{18}$ alkyl ester or acrylonitrile or an alkyl vinyl ether, vinyl pyrrolidone or vinyl acetate. Typical such polymers contain 10–100 mol % of recurring units of the formula:

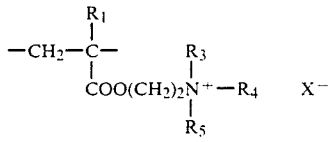

5 and 0–90 mol % of recurring units of the formula:

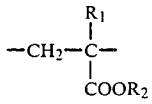

in which $R_1$ represents hydrogen or a lower alkyl radical, typically of 1–4 carbon atoms, $R_2$ represents a long chain alkyl group, typically of 8 to 18 carbon atoms, $R_3$, $R_4$ and $R_5$ independently represent hydrogen or a lower alkyl group while X represents an anion, typically a halide ion, a methosulfate ion, an ethosulfate ion or 1/n of a n valent anion.

Other quaternary ammonium polymers derived from an unsaturated monomer include the homo-polymer of diallyldimethylammonium chloride which possesses recurring units of the formula:

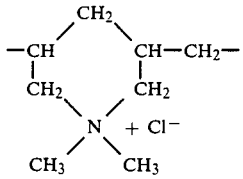

In this respect, it should be noted that this polymer should be regarded as "substantially linear" since although it contains cyclic groupings these groupings are connected along a linear chain and there is no crosslinking.

Other polymers which can be used and which are derived from unsaturated monomers inclue those having the formula:

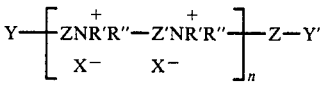

where Z and Z' which may be the same or different is $-CH_2CH{=}CHCH_2-$ or $-CH_2-CHOHCH_2-$, Y and Y', which may be the same or different, are either X or $-NH'R''$, X is a halogen of atomic weight greater than 30, n is an integer of from 2 to 20, and R' and R'' (I) may be the same or different alkyl groups of from 1 to 18 carbon atoms optionally substituted by 1 to 2 hydroxyl groups; or (II) when taken together with N represent a saturated or unsaturated ring of from 5 to 7 atoms; or (III) when taken together with N and an oxygen atom represent the N-morpholino group, which are described in U.S. Pat. No. 4,397,743. A particularly preferred such polymer is poly(dimethylbutenyl) ammonium chloride bis-(triethanol ammonium chloride).

Another class of polymer which can be used and which is derived from ethylenically unsaturated monomers includes polybutadienes which have been reacted with a lower alkyl amine and some of the resulting dialkyl amino groups are quaternised. In general, therefore, the polymer will possess recurring units of the formula:

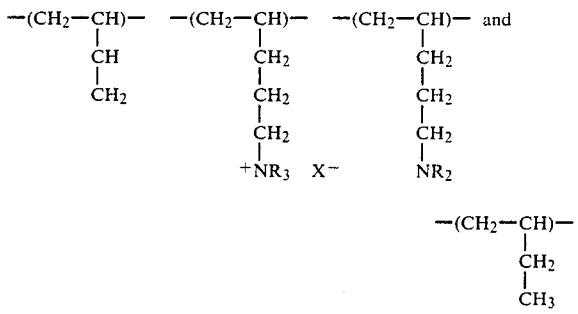

in the molar proportions $a:b_1:b_2:c$, respectively, where R represents a lower alkyl radical, typically a methyl or ethyl radical. It should be understood that the lower alkyl radicals need not all be the same. Typical quaternising agents include methyl chloride, dimethyl sulfate and diethyl sulfate. Varying ratios of $a:b_1:b_2:c$ may be used with the amine amounts $(b_1+b_2)$ being generally from 10–90% with $(a+c)$ being from 90%–10%. These polymers can be obtained by reacting polybutadiene with carbon monoxide and hydrogen in the presence of an appropriate lower alkyl amine.

Of the quarternary ammonium polymers which are derived from epichlorohydrin and various amines; particular reference should be made to the polymers described in British Specification Nos. 2085433 and 1486396. A typical amine which can be employed is N,N,N',N'-tetramethylethylenediamine as well as ethylenediamine used together with dimethylamine and triethanolamine. Particularly preferred polymers of this type for use in the present inventin are those having the formula:

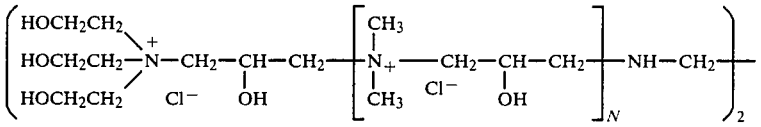

where N is from 0–500, although, of course, other amines can be employed.

Reference should be made to the above British Patent Specifications for further details.

Other polymers which can be used include protonated polymers such as polymers corresponding to the above quaternary ammonium polymers where the amine groups are not quaternised but are neutralised with acid, such as hydrochloric acid, as well as cationic tannin derivatives, such as those obtained by a Mannich-type reaction of tannin (a condensed polyphenolic body) with formaldehyde and an amine, formed as a salt e.g. acetate, formate, hydrochloride. These cationic tannin derivatives can also be quaternised. Further polymers which can be used include the polyamine polymers which have been crosslinked such as polyamideamine/polyethylene polyamine copolymers crosslinked with, said, epichlorohydrin.

The molecular weight of the polymers used can vary within broad limits, say from 250–10 million in some cases although, in general, the molecular weights will range from 250–1 million, especially 400–10,000.

The amounts of the components used do, of course, depend, to some extent, on the severity of the corrosion conditions and also on the pH of the system but, of course, corrosion inhibiting amounts are desirable. If the system is alkaline less salt can be used if the system is acid-dosed to a pH of, say 6.5 or 7. In general, however, from 1–50 ppm, especially from 1–10 ppm, and 1–3 ppm when orthophosphate or polyphosphate is also used, of each will be used and the relative amounts of the two components will generally vary from 1:10 to 10:1 by weight, especially with the polymer concentration being at least as great as that of the salt. If orthophosphate (or polyphosphate) is also used the relative amounts of orthophosphate (or polyphosphate): salt will generally vary from 1:10 to 10:1, especially 2:1 to 1:2, by weight, ortho or polyphosphate being expressed as $PO_4$. Usually the amount of salt will be from 1–10 ppm, especially from 1–3 ppm; similar quantities of orthophosphate or polyphosphate are suitable.

Although the components can be added to the system separately it will generally be more convenient to add them together as a single composition.

Accordingly, the present invention also provides a composition suitable for addition to an aqueous system which comprises a cationic polymer and a water soluble corrosion inhibiting metal salt which is capable of forming a passivating cathodic film of an insoluble salt of said metal.

The compositions of the present invention will normally be in the form of an aqueous solution containing, in general, from 1–25% by weight active ingredient (solids). A common concentration is from 5–10% by weight.

The additives used in the present invention can be used, sometimes advantageously, together with other water treatment additives such as phosphonates, dispersants such as sulphonated and carboxylated polymers, especially copolymers of maleic acid and sulphonated styrene or of methacrylic acid and 2-acrylamido-2-methyl propane sulphonic acid azoles such as benzotriazole and biocides such as isothiazolones, methylene bis(thiocyanate), quaternary ammonium compounds and chlorine release agents. In fact certain of the cationic polymers possess biocidal properties thereby enhancing the effect of the biocides. Advantageous results can frequently be obtained with phosphonates especially phosphonates which contain 3 acid groups which are carboxylic and phosphonic acid groups at least one of which is a phosphonic acid group and at least one of which is a carboxylic acid group, at least the said 3 acid groups being attached to carbon atoms, preferably with 2-phosphonobutane-1, 2,4-tricarboxylic acid and hydroxyethylidene diphosphonic acid.

The following Examples further illustrate the present invention.

EXAMPLES 1–10

Test Method

These Examples were carried out on a laboratory recirculating rig consisting of a plastic tank containing 8 liters of water and a heater (fitted with a temperature controller), the water being circulated via a centrifugal pump through glass tubing containing mild steel coupons and back to the tank. A mild steel test coupon was placed in the tank. Any evaporation during the test is replaced by de-ionised water fed into the tank through a constant level device. The corrosion rate is measured by the weight loss from the mild steel coupons.

The water used had the following analysis:

| | | |
|---|---|---|
| 80 ppm | Calcium Hardness | (expressed as calcium carbonate) |
| 25 ppm | Magnesium Hardness | |
| 100 ppm | 'M' Alkalinity | |
| 20 ppm | Sulphate (as $SO_4$) | |
| 24 ppm | Chloride (as Cl) | |
| 6 ppm | Silica (as $SiO_2$) | |
| Water temperature in tank | 130° F. | |
| Duration of test | 3 days | |
| Flow rate | 2 ft./sec. in tubing<br>0.2 ft./sec. in tank | |
| pH of system water | 8.6 | |
| Passivation | 1 day at 3 times the normal dose level. | |

| Example | Additive | Dose, ppm | Corrosion rate mpy Mild Steel (Tube) | Corrosion rate mpy Mild Steel (Tank) |
|---|---|---|---|---|
| 1 | Control | — | 43.2 | 45.7 |
| 2 | Polymer 1 | 10 | 58.1 | 73.8 |
| 3 | Zinc, $Zn^{2+}$ | 2.5 | 47.0 | 24.5 |
| 4 | Polymer 1/Zinc | 10/2.5 | 2.1 | 2.9 |
| 5 | Polymer 1 | 5 | 48.9 | 56.2 |
| 6 | Zinc, $Zn^{2+}$ | 5 | 40.7 | 21.6 |
| 7 | Polymer 1/Zinc | 2.5/2.5 | 4.5 | 4.9 |
| 8 | Zinc/Orthophosphate | 2.5/2.5 | 36.0 | 31.0 |
| 9 | Polymer 1/Zinc/ Orthophosphate | 2.5/1.25/1.25 | 2.5 | 2.8 |
| 10 | Polymer 1/Zinc/ Orthophosphate | 5/2.5/2.5 | 1.3 | 1.4 |

Polymer 1 is a polyquaternary ammonium compound formed by the reaction between Epichlorhydrin/Ethylene Diamine/Dimethylamine/Triethanolamine as described in British Patent Specification No. 2,085,433. Zinc was added in the form of Zinc Sulphate Monohydrate and Orthophosphate as Disodium Hydrogen Phosphate.

These Examples demonstrate the synergistic effect obtained by using Polymer 1 in conjunction with zinc ions alone, or in combination with orthophosphate ions, in the prevention of corrosion of mild steel.

EXAMPLES 11–18

These Examples illustrate the effectiveness of cationic polymers as compared with several much used phosphonates and polycarboxylates in combination with zinc. The test conditions employed are the same as for the previous examples.

| Example | Additive | Dose, ppm | Corrosion rate mpy. Mild Steel (Tube) | Corrosion rate mpy. Mild Steel (Tank) |
|---|---|---|---|---|
| 11 | Polymer 1/Zinc | 2.5/2.5 | 4.5 | 4.9 |
| 12 | Phosphonate 1 Zinc | 2.5/2.5 | 6.8 | 24.5 |
| 13 | Phosphonate 2/Zinc | 10/2.5 | 3.2 | 4.0 |
| 14 | Polymer 1/Zinc | 10/2.5 | 2.1 | 2.9 |
| 15 | Phosphonate 2/Ortho-phosphate/Zinc | 10/2.5/2.5 | 4.3 | 9.2 |

-continued

| Example | Additive | Dose, ppm | Corrosion rate mpy. Mild Steel (Tube) | Mild Steel (Tank) |
|---|---|---|---|---|
| 16 | Polymer 1/Ortho-phosphate/Zinc | 5/2.5/2.5 | 1.3 | 1.4 |
| 17 | Polymer 3/Zinc | 10/2.5 | 4.8 | 12.4 |
| 18 | Polymer 2/Zinc | 10/2.5 | 8.2 | 18.5 |

Phosphonate 1=Hydroxyethylidene diphosphonic acid.

Phosphonate 2=2 phosphonobutane 1, 2, 4 Tricarboxylic acid.

Polymer 2=Polyacrylic acid, molecular weight 2000.

Polymer 3=Phosphino polyacrylate, molecular weight 500.

It will be noted that in all cases where the cationic polymer (Polymer 1) is employed, the corrosion rate is lower than that obtained using anionic polymer or phosphonate.

EXAMPLES 19-22

These Examples show the very high degree of corrosion protection which can be obtained by the use of the cationic polymers in conjunction with a phosphonate and either zinc or zinc and orthophosphate. The same test procedure was used.

| Example | Additive | Dose, ppm | Corrosion rate mpy. Mild Steel (Tube) | Mild Steel (Tank) |
|---|---|---|---|---|
| 19 | Polymer 1/ Phosphonate 2/Zinc/ Orthophosphate | 4.4/4.4/2.2/3.0 | 0.9 | 1.2 |
| 20 | Phosphonate 2/Zinc Orthophosphate | 8.8/2.2/3.0 | 5.0 | 10.6 |
| 21 | Polymer 1/ Phosphonate 2/Zinc | 8.8/8.8/2.2 | 1.1 | 0.9 |
| 22 | Polymer 1/ Phosphonate 2/Zinc | 4.4/4.4/2.2 | 1.5 | 2.7 |

These results show the very low corrosion rates which may be obtained by the use of Polymer 1 in conjunction with Phosphonate 2, in particular, and zinc salt.

EXAMPLES 23-24

These Examples illustrate the use of other cationic polymers in combination with zinc salt and orthophosphate. The same test procedure was used.

| Example | Additive | Dose, ppm | Corrosion rate mpy. Mild Steel (Tube) | Mild Steel (Tank) |
|---|---|---|---|---|
| 23 | Polymer 4/Zinc/ Orthophosphate | 8.8/2.2/3 | 5.8 | 10.1 |
| 24 | Polymer 5/Zinc/ Orthophosphate | 8.8/2.2/3 | 4.3 | 9.6 |

Polymer 4=Cationic derivative of tannin.

Polymer 5=Copolymer of Lauryl Methacrylate and Methacryloyloxyethyl trimethylammonium methosulphate in mole ratio 40:60, having a molecular weight of 5000.

We claim:

1. A method for inhibiting corrosion in an aqueous system which comprises adding to the system at least one corrosion inhibiting zinc salt capable of forming a passivating film of a water insoluble salt of zinc at the cathode, and adding to the system a substantially linear cationic polymer having a molecular weight between about 400 and about 10,000; said polymer containing quaternary ammonium groups or protonated amine groups and being derived from reacting epichlorohydrin with amines selected from the group consisting of dimethylamine, triethanolamine, ethylene diamine and polyalkylene polyamines; and said polymer being added in an effective amount to significantly reduce the amount of said salt needed in the system for corrosion protection.

2. A method according to claim 1 in which the corrosion inhibiting salt is a sulphate, chloride or nitrate or a mixture thereof.

3. A method according to claim 1 in which the polymer is obtained by a reaction between epichlorohydrin and amines including dimethylamine and a polyalkylene polyamine.

4. A method according to claim 1 in which the salt is zinc sulphate.

5. A method according to claim 1 in which the polymer is one obtained by a reaction between a polyalkylene polyamine and epichlorohydrin.

6. A method according to claim 1 in which the cationic polymer contains quaternary ammonium groups.

7. A method according to claim 1 in which the cationic polymer is a polyquaternary ammonium compound formed by a reaction between epichlorohydrin, ethylene diamine, dimethylamine, and triethanolamine.

8. A method according to claim 1 in which the relative amount of the polymer and salt is from 1:10 to 10:1.

9. A method according to claim 1 in which the concentration of polymer is at least as great as that of the salt.

10. A method according to claim 1 in which the aqueous system is a cooling system.

11. A method according to claim 1 which comprises adding also an orthophosphate or polyphosphate.

12. A method according to claim 11 in which the orthophosphate or polyphosphate is an alkali metal salt.

13. A method according to claim 11 in which the orthophosphate is disodium or trisodium orthophosphate.

14. A method according to claim 1 in which the polymer is obtained by a reaction between epichlorohydrin and amines including ethylene diamine.

15. A method according to claim 14 in which the amines reacted to obtain the polymer further include triethanolamine.

16. A method according to claim 15 in which the cationic polymer has the formula:

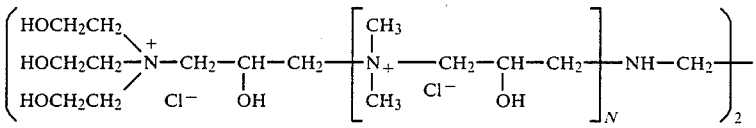

where N is from 0–500.

17. A method according to claim 15 in which the amines reacted to obtain the polymer further include dimethylamine.

18. A method according to claim 1 in which the cationic polymer and salts are present in an amount from 1 to 50 ppm.

19. A method according to claim 18 in which the cationic polymer and salts are present in an amount from 1 to 10 ppm.

20. A method according to claim 19 in which an orthophosphate is also added and the cationic polymer and salts are present in an amount from 1 to 3 ppm.

21. A composition for addition to an aqueous system which comprises at least one water soluble corrosion inhibiting zinc salt which is capable of forming a passivating cathodic film of an insoluble salt of zinc, and a substantially linear cationic polymer having a molecular weight between about 400 and about 10,000; said polymer containing quaternary ammonium groups or protonated amine groups and being derived from reacting epichlorohydrin with amines selected from the group consisting of dimethylamine, triethanolamine, ethylene diamine and polyalkylene polyamines.

22. A composition according to claim 21 which is in the form of an aqueous solution.

23. A composition according to claim 21 in which the active ingredients are present in an amount from 1 to 25% by weight.

24. A composition according to claim 21 in which the salt is a sulphate, chloride or nitrate.

25. A composition according to claim 21 in which the salt is not an ammonium salt.

26. A composition according to claim 21 in which the polymer is obtained by a reaction between epichlorohydrin and amines including dimethylamine and a polyalkylene polyamine.

27. A composition according to claim 21 in which the salt is zinc sulphate.

28. A composition according to claim 21 in which the polymer is one obtained by a reaction between a polyalkylene polyamine and epichlorohydrin.

29. A composition according to claim 21 in which the cationic polymer contains quaternary ammonium groups.

30. A composition according to claim 21 in which the cationic polymer is a quaternary ammonium compound formed by a reaction between epichlorohydrin, ethylene diamine, dimethylamine, and triethanolamine.

31. A composition according to claim 21 in which the concentration of polymer is at least as great as that of the salt.

32. A composition according to claim 21 which also comprises an orthophosphate or polyphosphate.

33. A composition according to claim 32 in which the orthophosphate or polyphosphate is an alkali metal salt.

34. A composition according to claim 33 in which the orthophosphate is disodium or trisodium orthophosphate.

35. A composition according to claim 21 in which the polymer is obtained by a reaction between epichlorohydrin and amines including ethylene diamine.

36. A composition according to claim 35 in which the amines reacted to obtain the polymer further include triethanolamine.

37. A composition according to claim 36 in which the cationic polymer has the formula:

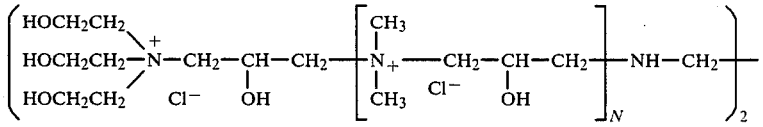

where N is from 0–500.

38. A composition according to claim 36 in which the amines reacted to obtain the polymer further include dimethylamine.

39. A composition according to claim 21 in which the relative amounts of the two components is from 1:10 to 10:1 by weight.

40. A composition according to claim 39 which contains an orthophosphate and the relative amounts of the two said components is from 2:1 to 1:2 by weight.

41. A composition according to claim 21 which also contains a phosphonate which contains 3 acid groups which are carboxylic and phosphinic acid groups at least one of which is a phosphinic acid group and at least one of which is a carboxylic acid group, at least the 3 said acid groups being attached to carbon atoms, a dispersant, an azole, or a biocide.

42. A composition according to claim 41 in which the phosphonate is 2-phosphono-butane-1,2,4-tricarboxylic acid.

43. A composition according to claim 21 which also contains at least one of a phosphonate, a dispersant, an azole, and a biocide.

44. A composition according to claim 43 in which the phosphonate is pentaphosphonomethylene substituted diethylenetriamine, the dispersant is a copolymer of maleic acid and sulphonated styrene or of methacrylic acid and 2-acrylamido-2-methylpropane sulphonic acid, the azole is benzotriazole and the biocide is an isothiazolone methylene bis(thiocyanate), a quaternary ammonium compound or a chlorine release agent.

* * * * *